US011299369B2

(12) United States Patent
Kuusinen et al.

(10) Patent No.: US 11,299,369 B2
(45) Date of Patent: Apr. 12, 2022

(54) METHOD FOR THE CALL ALLOCATION IN AN ELEVATOR GROUP

(71) Applicant: KONE Corporation, Helsinki (FI)

(72) Inventors: Juha-Matti Kuusinen, Helsinki (FI); Marja-Liisa Siikonen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 1178 days.

(21) Appl. No.: 15/819,719

(22) Filed: Nov. 21, 2017

(65) Prior Publication Data

US 2018/0093853 A1 Apr. 5, 2018

Related U.S. Application Data

(63) Continuation of application No. PCT/EP2015/062561, filed on Jun. 5, 2015.

(51) Int. Cl.
*B66B 1/34* (2006.01)
*B66B 1/24* (2006.01)

(52) U.S. Cl.
CPC ..... *B66B 1/3407* (2013.01); *B66B 1/2408* (2013.01); *B66B 2201/235* (2013.01); *B66B 2201/402* (2013.01)

(58) Field of Classification Search
CPC ..... B66B 1/3407; B66B 1/2408; B66B 2201/235; B66B 2201/402
See application file for complete search history.

(56) References Cited

U.S. PATENT DOCUMENTS 5,022,497 A * 6/1991 Thanagavelu ..... B66B 1/2458 187/382
5,056,628 A * 10/1991 Aime ..... B66B 1/2458 187/387
5,612,519 A * 3/1997 Chenais ..... B66B 1/2458 187/380
9,469,500 B2 * 10/2016 Friedli ..... B66B 1/468
2007/0084674 A1 * 4/2007 Tyni ..... B66B 1/20 187/382
2008/0302609 A1 * 12/2008 Siikonen ..... B66B 5/024 187/247

(Continued)

FOREIGN PATENT DOCUMENTS

CN 102745558 A 10/2012
GB 2 277 611 A 11/1994

(Continued)

OTHER PUBLICATIONS

International Search Report for PCT/EP2015/062561 (PCT/ISA/210) dated Feb. 18, 2016.

(Continued)

*Primary Examiner* — Jeffrey Donels
(74) *Attorney, Agent, or Firm* — Birch, Stewart, Kolasch & Birch, LLP

(57) ABSTRACT

A method for the call allocation in an elevator group uses a call allocation unit of an elevator group control. In the call allocation unit, passenger flow data of the elevator group is used to adapt call allocation parameters to improve the performance of the elevator group. The public traffic data is retrieved from at least one public transportation system, and is used to supplement expected passenger flow data for the adaption of call allocation parameters.

11 Claims, 1 Drawing Sheet

(56) References Cited

U.S. PATENT DOCUMENTS

| | | | | |
|---|---|---|---|---|
| 2009/0159374 | A1* | 6/2009 | Sorsa | B66B 1/2458<br>187/383 |
| 2014/0339023 | A1* | 11/2014 | Friedli | B66B 1/468<br>187/247 |
| 2016/0060076 | A1* | 3/2016 | Schroeder-Brumloop | G05B 15/02<br>187/247 |
| 2017/0369275 | A1* | 12/2017 | Saraswat | B66B 1/28 |
| 2020/0172371 | A1* | 6/2020 | Ding | B66B 1/3461 |
| 2020/0299099 | A1* | 9/2020 | Hatori | B66B 1/20 |

FOREIGN PATENT DOCUMENTS

| | | | |
|---|---|---|---|
| JP | 2-209386 | A | 8/1990 |
| JP | 11-209010 | A | 8/1999 |
| JP | 2005-200171 | A | 7/2005 |

OTHER PUBLICATIONS

Written Opinion of the International Searching Authority for PCT/EP2015/062561 (PCT/ISA/237) dated Feb. 18, 2016.

* cited by examiner

10

12
32
38
35
37
14
28
20
34
36
30
39
28
16
20
30
28
20
30
18
20

26
24
22

METHOD FOR THE CALL ALLOCATION IN AN ELEVATOR GROUP

CROSS REFERENCE TO RELATED APPLICATIONS

This application is a Continuation of PCT International Application No. PCT/EP2015/062561, filed on Jun. 5, 2015, which is hereby expressly incorporated by reference into the present application.

BACKGROUND OF THE INVENTION

The invention relates to a method for the call allocation in an elevator group using a call allocation unit of an elevator group control. In the call allocation unit, passenger flow data of the elevator group is used to adapt call allocation parameters to improve the performance of the elevator group. Currently it is known that call allocation units have a traffic processing unit which gathers—eventually employing a forecast unit—statistical and historical passenger flow data and processes expected passenger flows which are used to set operating parameters of elevator components, e.g. call allocation parameters of the allocation control, operating parameters of the doors as well as operating parameters of the elevator motor to optimally cope with the expected traffic in the elevator group. Thus, in the morning when heavy up traffic is expected, the elevator cars are controlled as to move downwards to the basement floor after the last passenger has exited the elevator at a destination floor so that it is ready for another upwards travel. Accordingly, also the door opening times in the exit floors can be shortened and the door opening times in the basement floor can be prolonged to meet the requirements of the certain traffic type. On the contrary, in the evening, the elevators are initiated to drive upwards after the passengers have exited the elevator in the base floor, which supports a better downwards performance of the elevator group. There are further traffic types as for example lunch peak traffic where calls are predominating running from all the different destination floors to a certain floor, where e.g. the cafeteria is located.

SUMMARY OF THE INVENTION

It is object of the present invention to improve the call allocation according to current requirements of passenger flow in the elevator group.

The object is solved with a method as well as with an elevator group. The inventive embodiments are also presented in the description part as well as in the figures of the present application. The inventive content may also consist of several separate inventions, especially if the invention is considered in the light of explicit or implicit subtasks or in respect of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

According to the invention, public traffic data is retrieved from at least one public transportation system which is for example a railroad company, bus company, tram or airline. The public traffic data is used to supplement the expected passenger flow data in the elevator group.

If for example the elevator group is located in a mall and the mall has a related railway station or metro station in its vicinity, the elevator group is informed via an interface about the public traffic data (actual schedule, i.e. arrival and departure times, passenger numbers or traffic density) of the correlated railway or metro company. This data is preferably provided in the known General Transit Feed Specification (GTFS) format which comprises the actual schedule of the public transportation as well as information about the traffic intensity as e.g. heavy traffic, light traffic or even the passenger numbers in a more or less sufficient accuracy. With this information, the allocation control of the elevator group control is able to calculate an expected passenger flow based on corresponding correlation data from the past or from statistical data. With this technology, the elevator group can be adapted with respect to its operation parameters, particularly call allocation parameters, as to optimally meet the requirements of the passenger flow to be expected from the public traffic data.

If for example a train arrives every hour, the elevator group can be set to upward peak traffic type in a time window of 2 to 15 minutes after arrival of the train, whereas after this time window, the elevator group can be reset to normal traffic type. During this upward peak traffic, the elevators are returned to the base floor after the last passenger has exited the corresponding elevator car. Furthermore, door opening times at the exit floors can be shortened and also other allocation parameters as passenger waiting time, riding time, energy consumption, door opening time, even the setting in and out of operation of certain elevators can be made dependent on the expected passenger flow based on the public traffic data. Accordingly, the invention has essential advantages with respect to current systems as it considers people movement in the environment of the elevator group in advance and therefore is thus able to meet upcoming demands which are not available from current data within the elevator group.

Of course, current elevator controls also have a forecast unit which uses past traffic data and statistical traffic data to estimate upcoming passenger flow. However, this technology fails if days are out of the routine, e.g. celebration days, school vacation periods and so on. With the consideration of actual real-time traffic data from the different public transportation companies, the elevator group is immediately able to cope with changed passenger flows even in case of unique events or occurrences.

Preferably, the public traffic data is obtained via a public communication network as e.g. the internet or a mobile phone network from the corresponding public transportation systems. Preferably, this data is retrieved in a standardized GTFS format so that it can be easily processed by a traffic processing unit in the call allocation unit.

The traffic processing unit may also be located separated from the call allocation unit but in connection with the elevator group control. The traffic processing unit may also forward data to the elevator group control to change operating parameters of elevator doors, elevator motors, as well as to the allocation control unit.

Preferably, the public traffic data is updated by real time data about the current schedule and/or traffic density as forwarded by the public transportation system via the public communication interface. Via this means, the available public traffic data is always updated to real time so that the elevator group is able to cope current passenger flow requirements.

In a preferred embodiment of the invention, a forecast unit is used to obtain expected passenger flow data which forecast unit uses a correlation between past public traffic data and correlated passenger flow data to obtain an estimate of the expected passenger flow data in connection with the current public traffic data (real time public traffic data) which estimated passenger flow data is used to adapt the call allocation parameters of the call allocation unit as well as optionally other operating parameters of elevator components. Based on statistical or historical data and/or using an optimisation method the call allocation unit is able to learn the correlation between the public traffic data and the related passenger flow in the elevator group. Thus, the elevator group is immediately able to retrieve from the current public traffic data an expected magnitude and/or change in the passenger flow in the elevator group so that the elevator group can be adapted to the expected needs real time in advance.

Preferably, a processor, preferably using an optimization method, is used in the call allocation unit to establish a correlation between public traffic data and passenger flow data based on historical and statistical data of the forecast unit. The optimisation method can be used to continuously improve the determination of the correlation between the public traffic data and the expected passenger flow data.

In a preferred embodiment of the invention, the public traffic data is used to decide on the number of active elevators of the elevator group to serve elevator calls. This allows a better adaption of the elevator group to an expected passenger flow. For example, if the public traffic data indicates that the passenger flow will decrease essentially, certain elevators can be put out of order to save energy and improve the efficiency of the call allocation. On the other hand, when from the public traffic data an increase of the passenger flow is to be expected, additional elevators can be put into service so that the elevator group has e.g. full transport capacity when the passengers from the public transportation system get into the area of the elevator group.

In a preferred embodiment of the invention, the public traffic data is used to set a certain traffic type for the setting of the call allocation unit. Such traffic types are for example peak up traffic, peak down traffic, lunch traffic, emergency traffic, etc.

Preferably, the public traffic data is used to switch between different call allocation modes as continuous call allocation and destination call allocation. In continuous call allocation, a floor call is made by pushing an up or down push-button so that the elevator group control is informed only about the desired travelling direction. An arriving elevator is thereby generally communicated with an acoustic signal as well as with the display of an up or down arrow in its vicinity to indicate the travelling direction of the elevator. This continuous call allocation is able to provide a high passenger transport capacity in peak times. On the other hand, the destination call allocation requires the input of the destination floor on the departure floor so that the elevator control and accordingly the call allocation unit knows the departure floor as well as the destination floor of the passenger. In this case, the passenger is immediately informed on a destination operation panel about the allocated elevator before its arrival at the departure floor. This destination call method reduces the overall calculation requirement of the elevator group control which is essential particularly in buildings with a lot of floors. Accordingly, the type or mode of call control can be made dependent upon the information from the public transportation systems which again increases the efficiency and the transport capacity of the elevator group.

The invention also relates to an elevator group comprising several elevators controlled by a common elevator group control. The group control comprises a call allocation unit for the allocation of the elevators to elevator calls. The call allocation unit is connected with a traffic processing unit which may be connected with or be part of the call allocation unit or of the elevator group control. The traffic processing unit is configured to retrieve and process passenger flow data of the elevator group to optimize the call allocation parameters of the call allocation unit and possibly operating parameters of elevator components. According to the invention, the traffic processing unit is connected via a data interface with a public transportation system to obtain public traffic data. The traffic processing unit is thereby configured to process the public traffic data into expected passenger flow data for the adaption of the call allocation parameters and/or the operating parameters of elevator components. The expected passenger flow data enables the elevator group to set the call allocation parameters and/or operating parameters of elevator components in advance, so that the elevator group is immediately ready to cope with changing passenger flows. Thus, the elevator group is already set to the changed passenger flow when the passenger flow really comes into the environment of the elevator group. Via this invention, the efficiency and the ability of the elevator group to adapt to even unique passenger flow occurrences is highly improved.

Preferably, the traffic processing unit comprises or is connected with a forecast unit preferably comprising a memory for traffic history of the elevator group. The forecast unit is configured to process the public traffic data into expected passenger flow data based on past and/or statistic correlations between the past public traffic data and the correlated passenger flow data. The elevator group control is therefore able to learn from statistics or from the past traffic correlations in how far a change of the public traffic data has an effect on expected passenger flow data which is of course essential for the setting of parameters of elevator components, e.g. the call allocation parameters of the call allocation unit. The elevator group is therefore able to immediately react on changing expected passenger flows with a high accuracy.

Preferably, the forecast unit comprises a memory to store past and current public traffic data and correlated passenger flow data whereby the correlation is not only related to the passenger number but also to the time relationship between the public traffic data and the correlated passenger flow data. For example, if a metro station is 5 walking minutes remote from the building where the elevator group is located, the expected passenger flow data of the corresponding public traffic data will regularly be delayed by roughly 5 minutes.

Preferably, the elevator group control comprises an interface with a public communication network as for example the internet and/or a mobile phone network. Via this interface, the elevator group is able to retrieve public traffic data from corresponding public transportation systems in a well specified manner, for example via the GTFS format, which is easy to process.

Preferably, the elevator control comprises a processor using an optimisation method to establish correlation between the public traffic data and the correlated expected passenger flow data. An optimisation method is sometimes used in call allocation for the optimization of the allocation process. This optimisation method can also be used for the optimization of the correlation between the public traffic data and the correlated passenger flow. The better the accuracy of such a correlation is, the better the elevator group is able to estimate from a certain public traffic data the impact on the passenger flow in the elevator group and correspondingly set the allocation parameters accordingly.

In a preferred embodiment of the invention, the elevator group comprises operating panels with push-buttons for destination call allocation as well as up/down push-buttons for continuous call allocation and the call allocation unit is configured to switch between continuous call allocation and destination call allocation in response to the public traffic data. Destination call allocation of course includes automatic issuing of a call via ID means, as e.g. ID cards. Thus, the present invention does not only enable the elevator group to adjust the allocation parameters according to an expected passenger flow in the elevator group but also to change the allocation method or mode to optimally meet the expected passenger flow, e.g. peak traffic up, peak traffic down, etc.

Of course, the public traffic data can be combined with other statistical data of the forecast unit to optimally meet an expected passenger flow in the elevator group, e.g. considering the daytime or season.

The public traffic data may comprise actual arrival times of public transportation systems in the vicinity of the environment of the elevator group.

The public traffic data may comprise actual number of passengers and/or traffic density data.

An elevator call is a car call or landing call, dependent on where the call is issued.

It is clear for the skilled person that the above-mentioned embodiments can be combined with each other arbitrarily. Furthermore, single components of the invention can be provided as a single separate component or integrated with other components. Accordingly, the elevator group control, the call allocation unit, the traffic processing unit as well as the forecast unit can be provided as separate modules or may be integrated in the elevator group control. The elevator group control can of course also be an elevator multi-group control which are used to control different elevator groups for example in different zones of a building, particularly of a high-rise building.

BRIEF DESCRIPTION OF THE DRAWINGS

The invention is hereinafter described with respect to the enclosed drawing. In this drawing

DESCRIPTION OF THE PREFERRED EMBODIMENTS

Figures 1, 2:
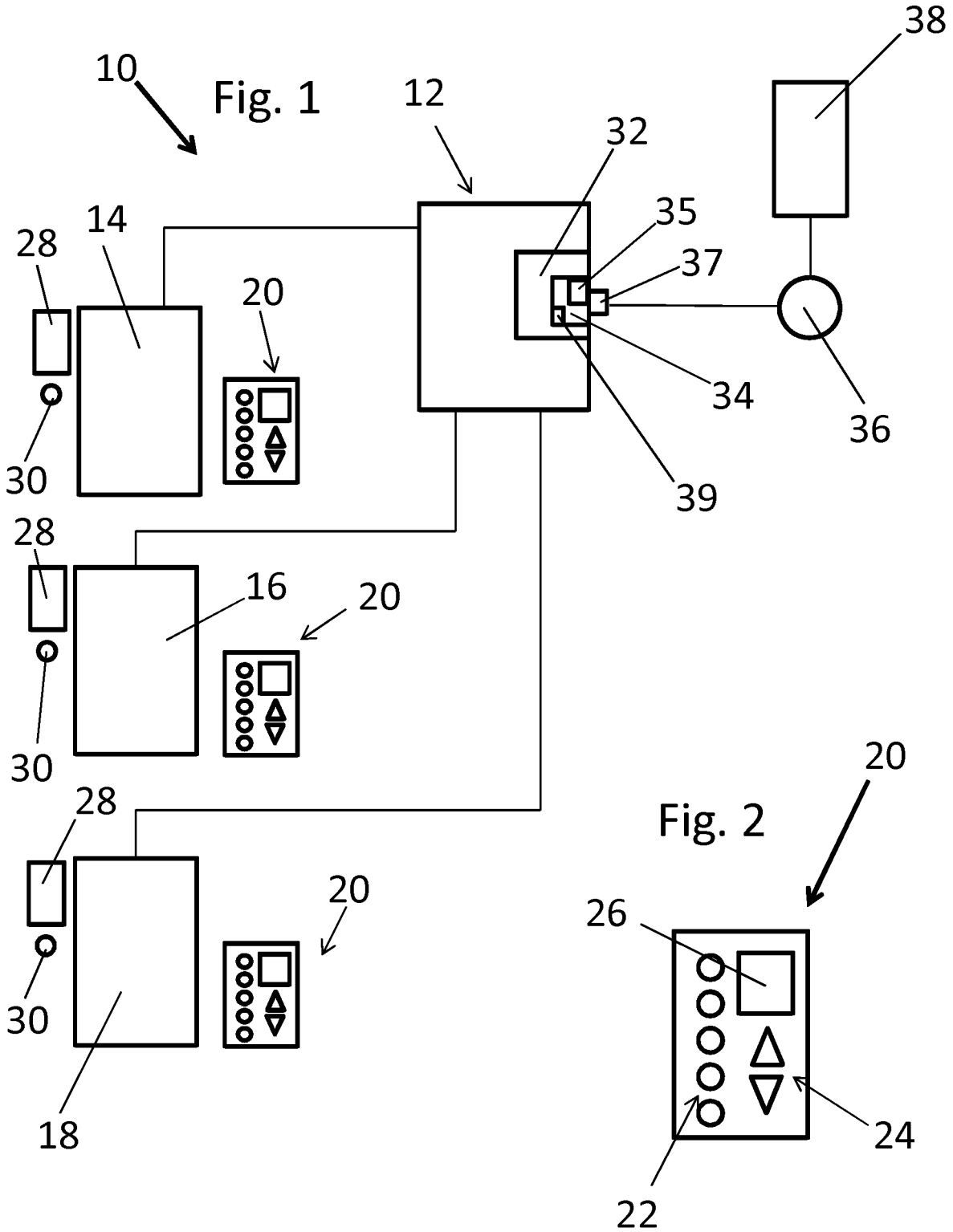
FIG. 1 shows an elevator group having a connection to a communal transport system for the optimization of call allocation, and FIG. 2 a detailed view of an operating panel as used in the elevator group of FIG. 1.

FIG. 1 shows an elevator group 10 having an elevator group control 12 controlling several elevators 14, 16, 18. Each elevator 14, 16, 18 has an operation panel 20 which is more detailed shown in FIG. 2. Each operating panel 20 comprises destination call buttons 22, up/down call buttons 24 as well as a display 26.

In the vicinity of the landing door of each elevator 14, 16, 18 an elevator display 28 is provided as well as a loudspeaker 30 or other audio output means, e.g. a bell or the like.

The elevator group control 12 comprises a call allocation unit 32 with a traffic processing unit 34. The traffic processing unit can also be located outside of the call allocation unit 32. The traffic processing unit 34 is connected with a forecast unit 35 as well as with a memory 39 for storing historical and statistical traffic data of the elevator group. The elevator control 12 is connected via a data interface 37 to a public communication network 36, e.g. internet and/or a mobile phone network, to which a server 38 of a public transportation system is connected, for example of a communal public transportation system. The public transportation system server 38 provides public traffic data, particularly travelling schedules as well as passenger data via the public communication network 36 to the traffic processing unit 34 of the allocation unit 32. Accordingly, the call allocation unit 32 is able to adapt call allocation parameters for the call allocation of the elevators 14, 16, 18 to given floor calls given via the operating panels 20 to the different elevators 14, 16, 18. Further, the elevator group control 12 is able to set operating parameters of elevator components as e.g. doors, motor etc.

The invention works as follows. The traffic processing unit 34 of the call allocation unit 32 gets via data interface 37 and the public communication network 36 public traffic data from the public transportation service server 38, particularly real time schedule data of the different lines of the public transportation system as well as passenger numbers. This public traffic data is fed to a forecast unit 35 in the traffic processing unit. The forecast unit 35 compares the real time public traffic data from the public transportation system server 38 with past public traffic data and/or statistical data and corresponding passenger flow data of the elevator group 10. Via this comparison, the allocation unit calculates information about when and in what amount the passenger flow will change based upon the public traffic data. The call allocation unit 32 is then able to adapt the call allocation parameters of the call allocation unit as for example passenger riding time, passenger waiting time, energy consumption, as well as operating parameters of elevator components, e.g. putting elevators in and out of service, changing door opening times as well as elevator speed and/or acceleration. Via the change of these call allocation parameters as well as elevator operation parameters, the elevator group control is able to optimally cope with the expected passenger flow calculated or estimated from the real time public traffic data.

The call allocation unit 32 is even able to switch between destination call control and continuous call control. In continuous call control, the destination call buttons 24 are deactivated which may e.g. be indicated by switching off their illumination and the up/down push-buttons 24 of the operation panel 20 are activated, which can be indicated by illumination. This may also be indicated in the display 26 of the operating panel so that passengers do not use the wrong push-buttons. In this continuous call control, the elevator displays 28 are initiated to only illuminate up/down arrows according to the travel direction of an arriving elevator 14, 16, 18 just before its arrival. The upcoming arrival of an elevator is also indicated acoustically via the loudspeaker 30 or other acoustic means.

If on the other hand destination call control is activated, the illumination of the up/down push-buttons 24 is switched off and the destination call push-buttons 24 are illuminated. The destination call push-buttons 22 may also be a decade keyboard for issuing two digit destination floors. After inputting the destination floor, the allocated elevator is immediately displayed on the display 26 of the operating panel 20. The elevator display 28 shows the destination floors of the corresponding elevator 14, 16, 18.

Accordingly, the invention allows the optimal adaptation of the elevator group to passenger flows.

The above-mentioned embodiment should not be limiting the invention but this may be varied within the scope of the appended patent claims.

LIST OF REFERENCE NUMBERS

10 elevator group
12 elevator group control

14 first elevator
16 second elevator
18 third elevator
20 operating panel
22 destination call push-buttons
24 up/down push-buttons
26 operating panel display
28 elevator display
30 loudspeaker
32 allocation control unit
34 traffic processing unit
35 forecast unit
36 public communication network
37 data interface
38 server of public transportation system
39 memory

The invention claimed is:

1. A method for the call allocation in an elevator group using a call allocation unit of an elevator group control, in which call allocation unit passenger flow data in the elevator group is used to adapt call allocation parameters of elevator components to improve the performance of the elevator group, the method comprising the step of:

retrieving public traffic data from at least one public transportation system, the public traffic data being used to supplement expected passenger flow data for the adaption of call allocation parameters, wherein the public traffic data is used to decide on the number of elevators of the elevator group to serve elevator calls, set a certain traffic type for the setting of the call allocation unit or switch between continuous call allocation and destination call allocation.

2. The method according to claim 1, wherein the public traffic data is obtained via a public communication network from the public transportation system, in a General Transit Feed Specification (GTFS) format.

3. The method according to claim 2, wherein the public traffic data is updated by real-time data about the current schedule and/or traffic density as forwarded by the public transportation system via the public communication network.

4. The method according to claim 1, wherein a forecast unit is used to obtain expected passenger flow data, which forecast unit uses a correlation between past public traffic data and correlated passenger flow data to obtain an estimate of the expected passenger flow data in connection with the current public traffic data, which estimated passenger flow data is used to adapt the call allocation parameters.

5. An elevator group, comprising several elevators controlled by a common elevator group control, which group control comprises a call allocation unit for the allocation of elevators to elevator calls, which call allocation unit is connected with a traffic processing unit, which is configured to retrieve and process passenger flow data of the elevator group to optimise call allocation parameters of the call allocation unit, wherein the traffic processing unit is connected with a data interface configured to obtain public traffic data form a public transportation system, whereby the traffic processing unit is configured to process the public traffic data into expected passenger flow data for the adaption of call allocation parameters, and wherein the public traffic data is used to decide on the number of elevators of the elevator group to serve elevator calls, set a certain traffic type for the setting of the call allocation unit or switch between continuous call allocation and destination call allocation.

6. The elevator group according to claim 5, wherein the traffic processing unit comprises a forecast unit comprising a memory for a traffic history of the elevator group, which forecast unit is configured to process the public traffic data into expected passenger flow data based on past and/or statistic correlations between the public traffic data and the correlated passenger flow.

7. The elevator group according to claim 6, wherein the forecast unit comprises a memory, configured to store public traffic data and correlated passenger flow data or corresponding correlation data.

8. The elevator group according to claim 5, wherein the elevator group control comprises a data interface with a public communication network.

9. The elevator group according to claim 5, comprising operating panels with destination push-buttons for destination call allocation and up/down push-buttons for continuous call allocation and wherein the call allocation unit is configured to switch between continuous call allocation and destination call allocation in response to the public traffic data.

10. The method according to claim 2, wherein a forecast unit is used to obtain expected passenger flow data, which forecast unit uses a correlation between past public traffic data and correlated passenger flow data to obtain an estimate of the expected passenger flow data in connection with the current public traffic data, which estimated passenger flow data is used to adapt the call allocation parameters.

11. The method according to claim 3, wherein a forecast unit is used to obtain expected passenger flow data, which forecast unit uses a correlation between past public traffic data and correlated passenger flow data to obtain an estimate of the expected passenger flow data in connection with the current public traffic data, which estimated passenger flow data is used to adapt the call allocation parameters.

* * * * *